United States Patent [19]

Belcher

[11] 4,162,944

[45] Jul. 31, 1979

[54] SPOTTING METHOD AND APPARATUS FOR COKE OVEN BATTERIES

[75] Inventor: John A. Belcher, Pleasant Hills Borough, Pa.

[73] Assignee: United States Steel Corporation, Pittsburgh, Pa.

[21] Appl. No.: 850,768

[22] Filed: Nov. 11, 1977

[51] Int. Cl.[2] ..... C10B 33/10; C10B 41/02; G01S 5/16

[52] U.S. Cl. ..... 201/41; 33/286; 202/262; 202/270; 250/342; 250/491

[58] Field of Search ..... 201/1, 41; 202/248, 202/262, 270; 250/342, 491; 49/31; 33/286–289

[56] References Cited

U.S. PATENT DOCUMENTS

| | | | |
|---|---|---|---|
| 2,760,270 | 8/1956 | Sims | 33/286 |
| 3,451,898 | 6/1969 | Lo Presti et al. | 202/248 |
| 3,464,894 | 9/1969 | Tatterson | 202/262 |
| 3,842,279 | 10/1974 | Schumacher | 250/491 |

FOREIGN PATENT DOCUMENTS

| | | | |
|---|---|---|---|
| 2203524 | 8/1973 | Fed. Rep. of Germany | 202/270 |
| 2540318 | 10/1976 | Fed. Rep. of Germany | 202/262 |
| 7009105 | 12/1970 | Netherlands | 202/262 |

*Primary Examiner*—Morris O. Wolk
*Assistant Examiner*—Bradley Garris
*Attorney, Agent, or Firm*—Walter P. Wood

[57] ABSTRACT

A method and apparatus for spotting a pusher machine or other door-handling machine in relation to a coke oven. The method and apparatus are particularly useful for aligning a door extractor carrying a door with an open hot oven, but also may be used to align a pusher ram. The apparatus includes left and right heat or light sensitive detectors at opposite sides of the part to be aligned with the oven and aimed at oblique angles toward the extended center line of the part. When both detectors are actuated simultaneously, the part is aligned accurately with the oven.

8 Claims, 2 Drawing Figures

SPOTTING METHOD AND APPARATUS FOR COKE OVEN BATTERIES

Figure 1:
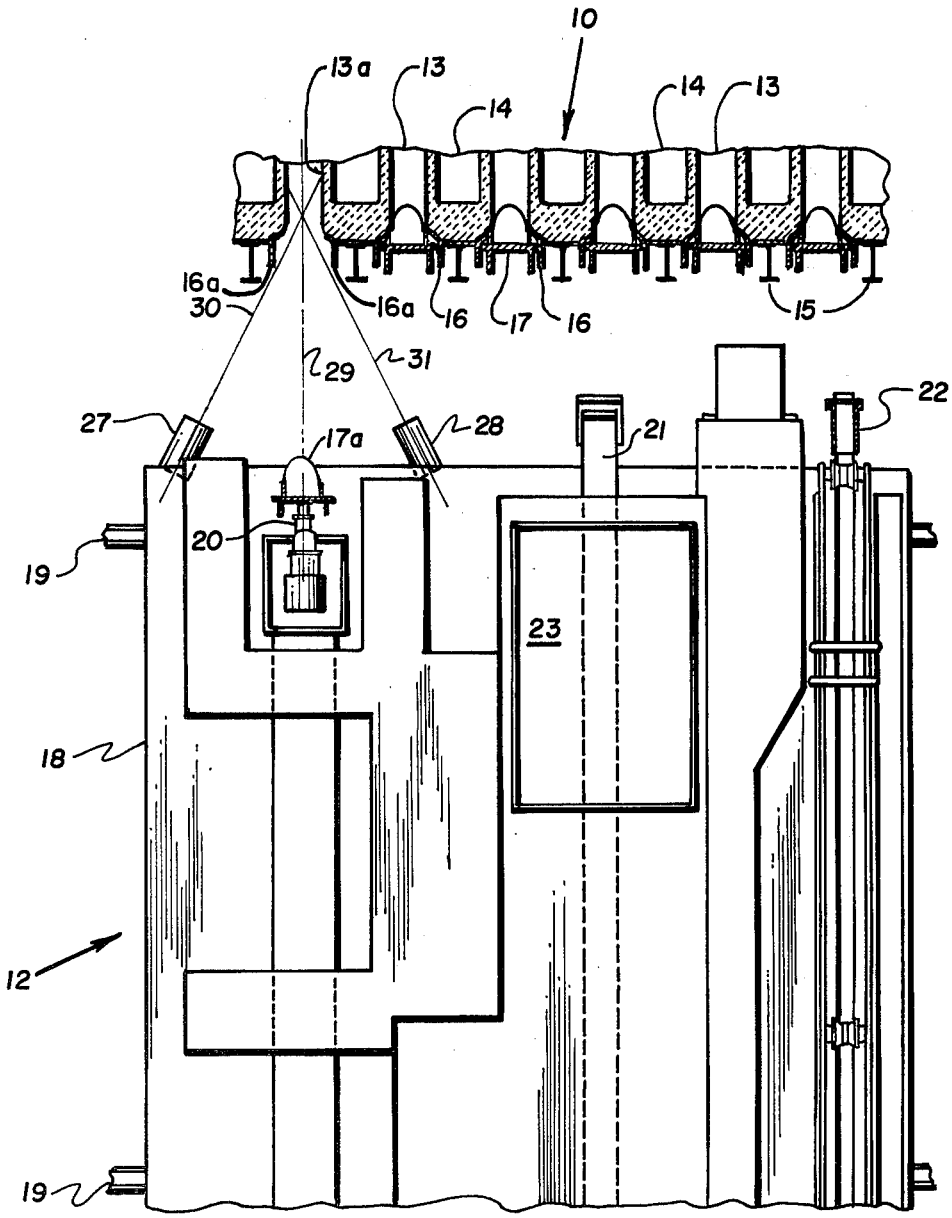

This invention relates to an improved method and apparatus for spotting a pusher machine or other door-handling machine in relation to a coke oven.

A conventional pusher machine operates along a track at the pusher side of a battery of coke ovens, and includes a door extractor, a pusher ram, and a leveler bar. At the completion of the coking process in each oven, when the coke is ready for pushing, the pusher machine is spotted first for the door extractor to remove the door. Next the machine runs along the track to align the pusher ram with the open oven and push the coke. Therafter the machine returns to its former position to replace the door. The operator occupies a cab out of alignment with the door extractor. Hence it is difficult for him to spot the machine accurately for replacing a door. Unless the door is aligned accurately with the door jamb, the sealing means do not engage properly to prevent leakage of gas or tar from the oven, or damage to the door may result. It is important also for the pusher ram to be aligned accurately with the open door before it enters the oven and similar problems may arise in spotting a door-handling machine at the coke side of the battery. Devices are known for assisting an operator in spotting a pusher machine or other door-handling machine, but the known devices have not been altogether satisfactory and are not widely used. For exemplary showings of such devices, reference can be made to Sims U.S. Pat. No. 2,760,270 or Lo Presti et al U.S. Pat. No. 3,451,898.

An object of the present invention is to provide an improved spotting method and apparatus which are fully reliable and simple mechanically and may be used for aligning a part of a pusher machine (for example, a door extractor or a pusher ram) or other door-handling machine with an open hot oven.

A more specific object is to provide an improved spotting apparatus and method in which heat or incandescence of the walls of an open hot oven is utilized to actuate a pair of sensors on the pusher machine or other door-handling machine aimed where both sensors are actuated simultaneously only when the machine is spotted accurately in relation to the oven.

Figure 2:
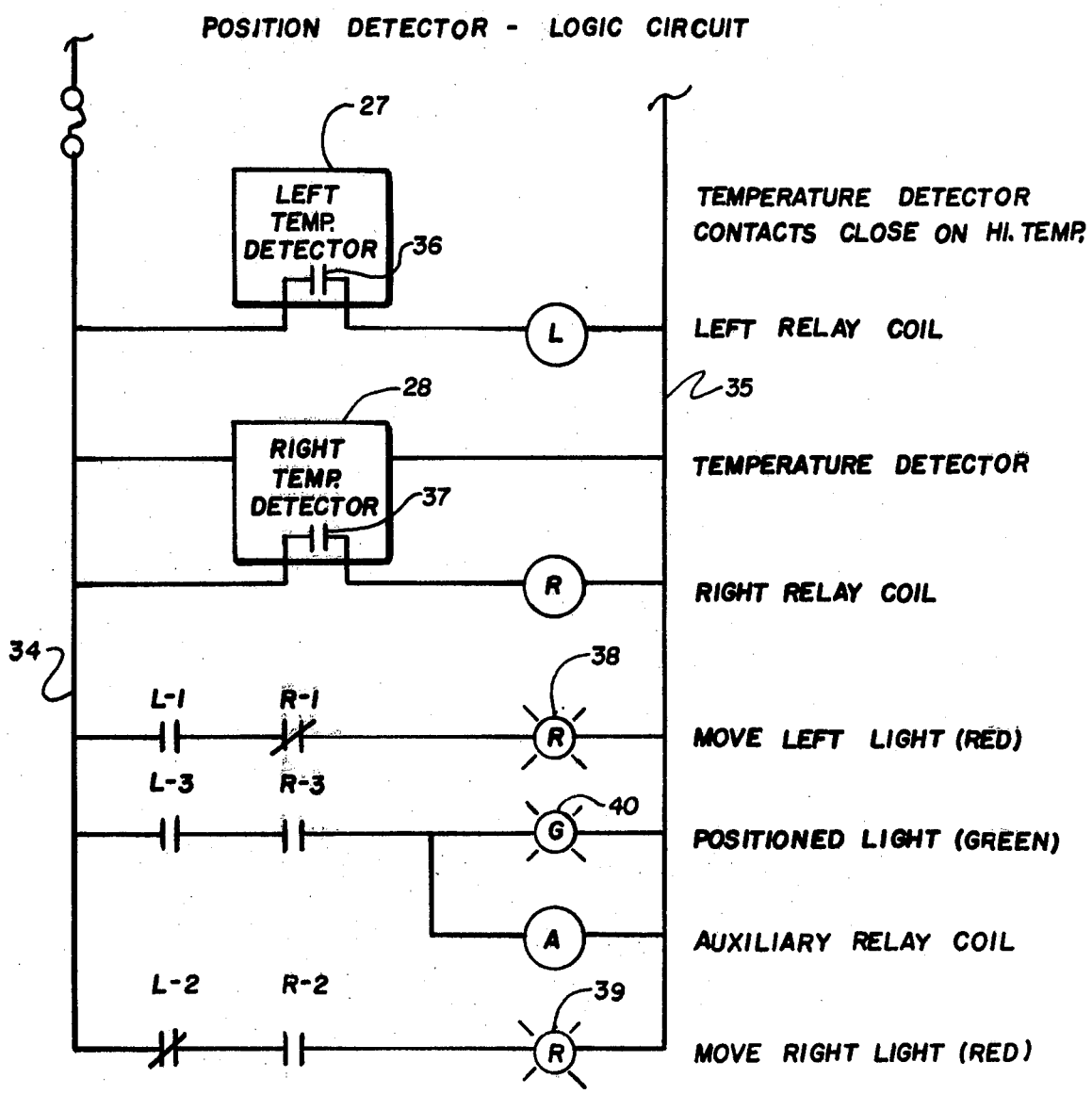

In the drawing:

FIG. 1 is a diagrammatic top plan view of a portion of a coke oven battery and a pusher machine equipped with the spotting apparatus of the invention; and FIG. 2 is a schematic diagram of a suitable electric circuit which may be embodied in the apparatus.

FIG. 1 shows diagrammatically a portion of a coke oven battery 10 and a pusher machine 12. The battery 10 includes a plurality of ovens 13, flue chambers 14 between ovens, and buckstays 15 supporting the structure. Each oven has its respective door jamb 16 and removable door 17 at the pusher side. The pusher machine includes a carriage 18. The pusher machine travels on a track 19 parallel with the side of the battery. Mounted on the carriage are a door extractor 20, a pusher ram 21, a leveler bar 22, and an operator's cab 23. The door extractor is illustrated as carrying one of the doors designated 17*a*. The open hot oven is designated 13*a* and its jamb 16*a*. The battery and pusher machine are conventional apart from the spotting apparatus, and hence are not shown in greater detail.

In accordance with the invention, left and right detectors 27 and 28 are mounted on carriage 18 on opposite sides of a part of the machine to be aligned with an open hot oven, for example the door extractor 20. Preferably the detectors are sensitive to infrared radiation, but alternatively other heat or light sensitive detectors may be used. Preferably the detectors are at a height about midway of the height of the ovens. The detectors are aimed at equal but opposite oblique angles from the left and right toward the extended center line 29 of the door extractor or other part which is to be aligned with the open hot oven. The lines of sight to the left and right detectors 27 and 28 are indicated at 30 and 31 respectively.

Both detectors can "see" a hot wall of an open oven 13*a* simultaneously only when the door extractor 20 and door 17*a* are aligned accurately with the oven. If the extractor and door are slightly to the right of a position of alignment, the left detector 27 "sees" the hot wall at the right side of the oven, but the cooler jamb 16*a* interrupts the line of sight 31 to right detector 28. The reverse is true if the extractor and door are slightly to the left of a position of alignment. Neither detector "sees" a hot wall if the extractor is out of alignment by approximately half the width of an oven. A similar arrangement of detectors can be installed on the carriage 18 on opposite sides of the pusher ram 21 if it is desired to control alignment of the pusher ram in the same manner.

FIG. 2 shows schematically one form of electric circuit which may be used with the detectors 27 and 28. The circuit includes two lines 34 and 35 connected to a suitable power source. The two detectors are connected in parallel across these lines, and include normally open contacts 36 and 37 respectively which close when the corresponding detector "sees" a hot wall. Left and right relay coils L and R are connected across lines 34 and 35 in series with contacts 36 and 37 respectively to be energized when the contacts close. Normally open contacts L-1 of relay L, normally closed contacts R-1 of relay R, and a signal light 38 (for example red) are connected in series across lines 34 and 35. Similarly normally closed contacts L-2, normally open contacts R-2, and a signal light 39 (for example red) are connected in series across lines 34 and 35. Normally open contacts L-3 and R-3 and another signal light 40 (for example green) also are connected across these lines. An auxiliary relay coil A optionally may be connected in parallel with the light 40.

As long as neither detector 27 or 28 "sees" a hot wall, neither relay L or R is energized, and contacts L-1, R-2, L-3 and R-3 all are open, and signal lights 38, 39 and 40 are extinguished. When the left detector 27 "sees" a hot wall but the right detector 28 does not, relay L is energized, contacts L-1 close, and light 38 comes on. This tells the operator to move the pusher machine 12 a little to the left. Similarly when the right detector 28 "sees" a hot wall but the left detector 27 does not, light 39 comes on and tells the operator to move the pusher machine a little to the right. When both detectors 27 and 28 see a hot wall simultaneously, contacts L-3 and R-3 both close and light 40 comes on. Contacts R-1 and L-2 open and lights 38 and 39 both are extinguished. This tells the operator the door 17*a* (or pusher ram 21) is aligned with the open oven 13*a* and the machine is spotted accurately. The auxiliary relay A may be used in a permissive circuit which prevents operation of the door extractor (or pusher ram) unless the machine is spotted accurately.

From the foregoing description, it is seen that the present invention affords a simple and almost foolproof method and apparatus for assuring that a pusher machine or other door handling machine accurately is spotted before a door is replaced on an open oven or a pusher ram enters the oven. While I have shown a simple relay circuit for indicating the position of the machine in relation to an open oven, it is apparent that other arrangements can be used, for example a solid state circuit. Although I prefer heat sensitive detectors, light sensitive detectors can be substituted, since the hot walls are incandescent. A similar spotting apparatus may also be applied to the door handling machine at the coke side of the battery.

I claim:

1. A method of spotting a machine in relation to an open hot coke oven, the walls of which have incandescent surfaces, so that a part of the machine is aligned accurately with the oven, said method comprising aiming detectors at oblique angles toward the extended center line of said part from both the left and right sides thereof, and positioning the machine where both said detectors "see" directly the incandescent surfaces of the walls at opposite sides of the open oven simultaneously.

2. A method as defined in claim 1 in which said part is a door extractor carrying a door to be replaced on the oven.

3. A method as defined in claim 1 in which said detectors are heat sensitive or light sensitive.

4. A method as defined in claim 1 comprising moving the machine to the left when the detector aimed from the left side "sees" an incandescent wall surface, but the detector aimed from the right side does not, and moving the machine to the right when the detector aimed from the right side "sees" an incandescent wall surface, but the detector aimed from the left side does not.

5. The combination, with a battery of coke ovens and a machine movable alongside said battery, said ovens including respective jambs and removable doors received in said jambs;

said machine including a part to be aligned with an open hot-oven, the walls of which have incandescent surfaces;

of a spotting apparatus comprising:

left and right detectors mounted on said machine at opposite sides of said part aimed at oblique angles from the left and right toward the extended center line of said part;

and means for indicating when both said detectors "see" directly the incandescent surfaces of the walls at opposite sides of an open hot oven simultaneously.

6. A combination as defined in claim 5 in which said machine is a pusher machine and said part is a door extractor.

7. A combination as defined in claim 5 in which said detectors are heat sensitive or light sensitive.

8. A combination as defined in claim 5 in which said indicating means includes means for indicating that either of said detectors "sees" an incandescent wall surface while the other detector does not.

* * * * *